United States Patent [19]

Morrow et al.

[11] Patent Number: 4,769,931

[45] Date of Patent: Sep. 13, 1988

[54] CLEATED SOLE FOR FOOTWEAR

[76] Inventors: Donald W. Morrow, 665 Barrymore St., Phillipsburg, N.J. 08865; Richard C. Cotton, 180 N. Prospect St., Washington, N.J. 07882

[21] Appl. No.: 82,275

[22] Filed: Aug. 6, 1987

[51] Int. Cl.[4] ..... A43B 5/00; A43C 15/00

[52] U.S. Cl. ..... 36/134; 36/59 R; 36/67 R; D2/321

[58] Field of Search ..... 36/134, 59 R, 59 A, 36/59 B, 59 C, 67 R, 67 A, 67 B, 67 C, 67 D, 124, 111, 112, 1; D2/273, 274, 317, 321

[56] References Cited

U.S. PATENT DOCUMENTS

| | | | |
|---|---|---|---|
| D. 263,647 | 4/1982 | Railton | D2/321 |
| D. 281,287 | 11/1985 | Vitrac | D2/321 |
| 1,011,110 | 12/1911 | Brown | 36/59 A |
| 3,402,485 | 9/1968 | McMorrow | 36/1 |
| 4,392,312 | 7/1983 | Crowley et al. | 36/67 R |

FOREIGN PATENT DOCUMENTS

| | | | |
|---|---|---|---|
| 507291 | 12/1957 | Belgium | 36/59 B |
| 484444 | 10/1917 | France | 36/59 R |
| 1216016 | 4/1960 | France | 36/128 |
| 591601 | 4/1959 | Italy | 36/59 C |

*Primary Examiner*—Steven N. Meyers

*Attorney, Agent, or Firm*—Steele, Gould & Fried

[57] ABSTRACT

A cleated sole for footwear intended primarily for serious sportsmen and trackers uses ovaloid pairs of cleats. The preferred embodiment utilizes cleat pairs which include two depressions on their ground contacting base, and a shallow transverse depression across the cleat pair base's rear. The footwear sole has improved traction, balance, and quietness.

10 Claims, 4 Drawing Sheets

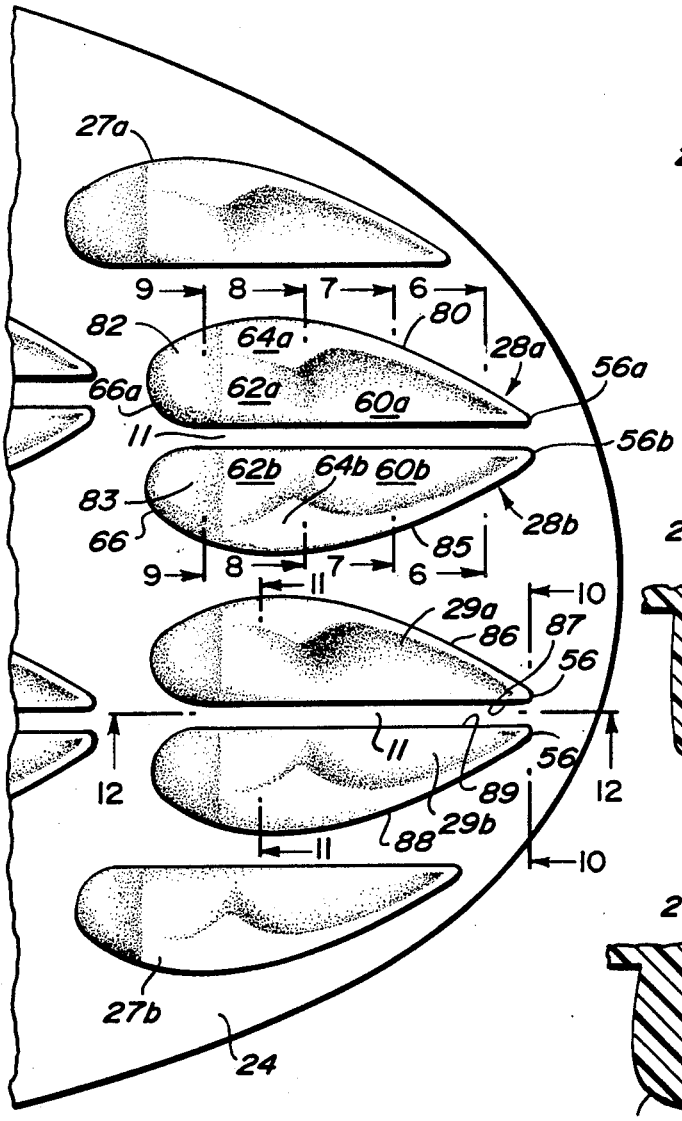
FIG. 5
FIG. 6
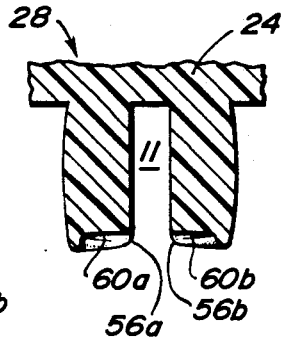
FIG. 7
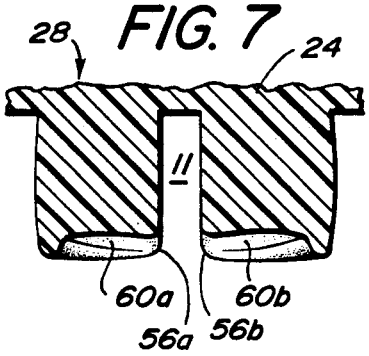
FIG. 8
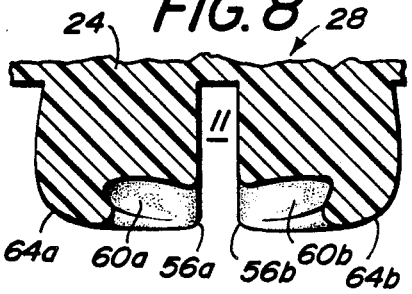
FIG. 9
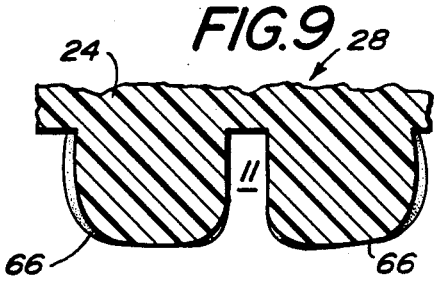

FIG. 10
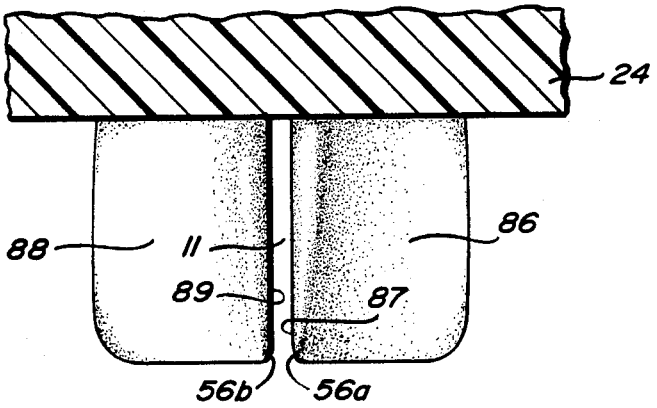
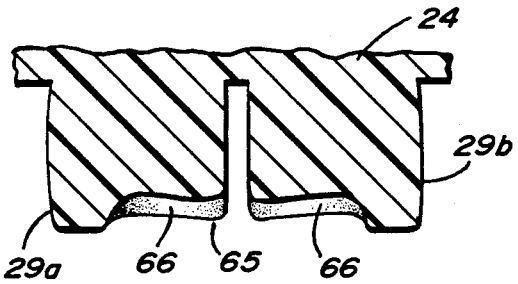
FIG. 11
FIG. 12
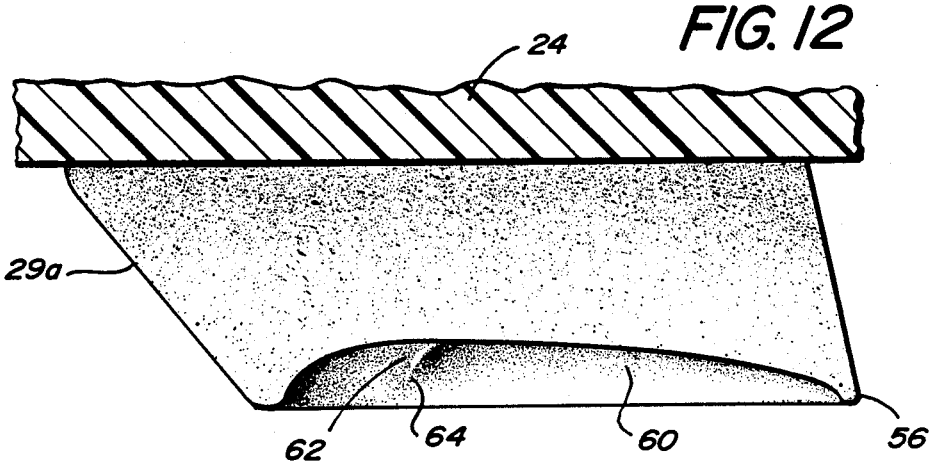

CLEATED SOLE FOR FOOTWEAR

BACKGROUND OF THE INVENTION

1. Field of the Invention

This invention relates to footwear and, more particularly, to cleats on the soles of footwear for the outdoorsman.

2. Description of the Prior Art

Many different specialized kinds of footwear are available on the market. Hunting and hiking boots are designed for both comfort and durability in the outdoors. Some boot soles are designed to have increased traction for climbing rocky or other special terrains. Other shoes and boots have been designed for use in special games, such as soccer and baseball. These shoes have special cleats on their soles to provide improved traction while running on grass or artificial turf.

Treads on the shoe shole which resemble animal prints are also known. U.S. Pat. No. Des. 281,287 to Vitrac and U.S. Pat. No. 3,402,495 to McMorrow show paws, while U.S. Pat. No. Des. 263,646 and U.S. Pat. No. Des. 263,647 show hooves. None of the aforementioned references show a detail pattern intended for the serious hunter and tracker. McMorrow, the only utility, is clearly a toy for training Boy Scouts.

Heretofore, no one has contemplated a cleated pattern inspired by animal hooves, but adapted for shoes or boots, and which is intended to improve both traction and quietness for the hunter or serious tracker.

SUMMARY OF THE INVENTION

The aforementioned prior art problems are obviated by the cleated sole for footwear of this invention. The footwear sole of this invention is designed to increase traction, reduce skidding, and provide quietness for a hunter is mixed and sometimes difficult terrain, and can be especially useful for tracking wounded and rapidly moving game or when running with tracking dogs.

Each sole (including the heel) has a plurality of pairs of cleats mounted on its outer face. The pairs may be arranged in rows or randomly placed the cleat pairs may be identically sized cleats, or they may be different sizes. The cleat pairs occupy, generally, the entire shoe sold, including the heel.

Each pair of cleats is composed of two spaced apart cleats which are mirror images of each other along the longitudinal axis separating them. Each cleat is generally an uneven ovaloid of a generally tear-drop shape with one straight side wall and one curved side wall. The tips of the tear drops point to the shoe front and the generally straight side walls face each other. Each cleat pair has an eliptical flat surface where it joins the sole. The cleat's side walls extend downward, the outside wall curving inward, to form a flat ground engaging base to touch the ground. The base includes a depression on the interior straight side, bordered by the curved side wall and including a cusp which divides the depression generally into two areas.

It is, therefore, an object of this invention to provide footwear of improved traction and quietness for outdoorsmen.

It is another object of this invention to provide cleated footwear for the hunter and tracker.

It is another object of this invention to provide a sole with cleats minimizing wearer contact with the ground surface to lessen noise level.

It is still another object of this invention to distribute the user's weight over the sole surface to minimize skidding.

It is yet another object of this invention to provide a sole with improved traction which is suitable for either shoe or boot.

It is yet a further object of this invention to provide a cleat for a sole in which the cleat includes a depression to grasp the ground.

These and other objects will be more readily ascertainable to one skilled in the art from a consideration of the following Figures, description and exemplary embodiments.

BRIEF DESCRIPTION OF THE DRAWING(S)

FIG. 5 is a partial enlargement of FIG. 3 at the toe end looking from toe to heel, with shading to shoe details of the cleat.

FIGS. 6, 7, 8 and 9 are progressive horizontal cross sections of cleat pair 28.

FIG. 6, taken on lines 6—6 of FIG. 5, is a cross section of cleat pair 28 looking toward the toe end of the sole.

FIG. 7, also a cross section of cleat pair 28, is taken on lines 7—7 of FIG. 5.

Likewise, FIG. 8 is a cross section of cleat pair 28 taken on lines 8—8 of FIG. 5.

Lastly, FIG. 9 is a cross section of cleat pair 28 taken on lines 9—9 of FIG. 5.

FIG. 10 shows cleat pair 29 and is taken on lines 10—10 of FIG. 5 looking from the toe end to the heel end of the shoe.

FIG. 11 is a cross section of cleat pair 29 taken on lines 11—11 of FIG. 5.

FIG. 12 is a longitudinal cross section of cleat pair 29 taken on lines 12—12 of FIG. 5.

DETAILED DESCRIPTION OF THE PREFERRED EMBODIMENT(S)

Figure 1:
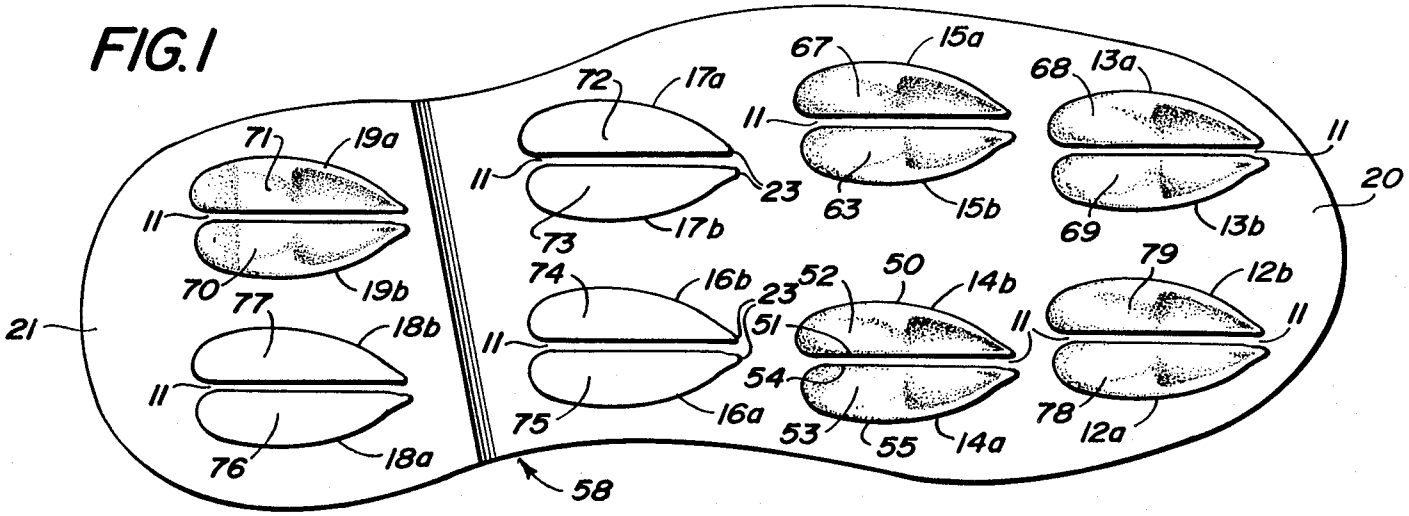
FIG. 1 is bottom view of a shoe or boot sole which includes four rows of eight pairs of identically sized cleats. The cleats shown in this Figure are intended to indicate position and are not shaded to show full detail.
Figure 2:
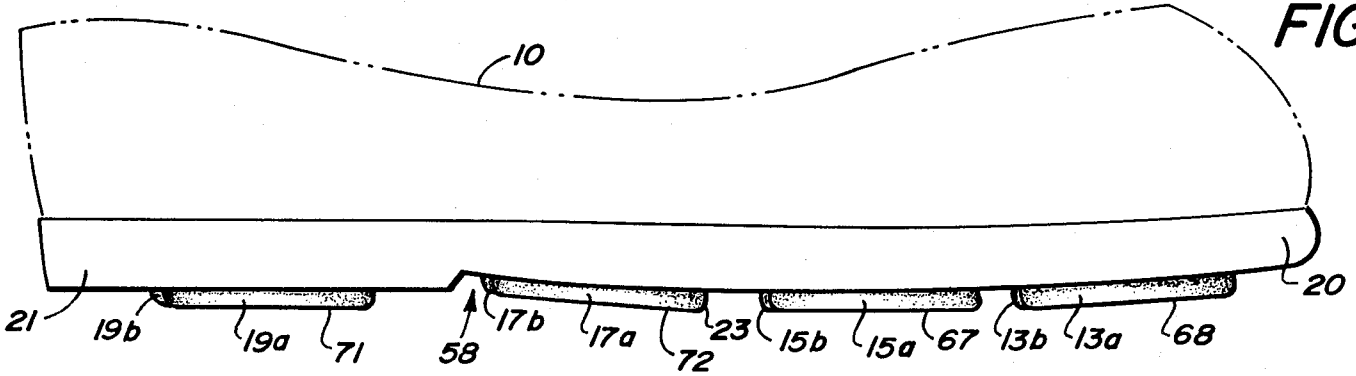
FIG. 2 is a side view of the sole of FIG. 1, a shoe upper shown in phantom.

Referring now to the drawings, and more particularly to FIGS. 1 and 2, sole 20 and heel 21 are seen on shoe upper 10 (shown in phantom). Fastened to sole 20 are six pairs of cleats: **12*a* and 12*b*, 13*a* and 13*b*, 14*a* and 14*b*, 15*a* and 15*b*, 16*a* and 16*b*, 17*a* and 17*b*, On heel 21 are shown cleat pairs 18*a* and 18*b*, and 19*a* and 19*b*. Each pair is composed of two cleats which are mirror images of each other along valley 11 which runs longitudinally between the pairs. For purposes of illustration, only one pair of cleats, 14*a* and 14*b*, will be described in detail as to overall shape and position, the other cleat pairs being understood to likewise include the same details. Details of internal depressions and other details are discussed in reference to FIGS. 5–12**.

Cleats **14*a* and 14*b* are generally ovaloids (see also FIG. 11) and teardrop in shape in longitudinal cross section, with generally straight opposing inside walls 51 and 54 and generally curved outside walls 50 and 55**.

Their tops (not shown) are planar at their attachment to sole 20, which is likewise planar. Their bases, 52 and 53, are generally flat to provide a flat and continuous walking surface to sole 20 except for depressions to be discussed in respect to subsequent figures. The cleat pairs are separated from each other by valley 11 and are mirror images of each other along the longitudinal axis formed by valley 11.

As can be seen in FIG. 2, sole 20 and heel 21 and approximately the same thickness so that the flat cleat bases—bases 76 and 77 on cleats 18*a* and 18*b* respectively, bases 70 and 71 on cleats 19*b* and 19*a* respectively, bases 67 and 63 on cleats 15*a* and 15*b* respectively, bases 52 and 53 on cleats 14*b* and 14*a* respectively, bases 68 and 69 on cleats 13*a* and 13*b* respectively, and bases 78 and 79 on cleats 12*a* and 12*b* respectively—are all on generally the same horizontal plane to facilitate walking. Bases 72 and 73 on cleats 17*a* and 17*b* and bases 74 and 75 on cleats 16*a* and 16*b* are slightly tilted at tips 23 and are on a different plane than the aforesaid bases because of arch 58 of shoe 10. The number of cleats provided (sixteen in this embodiment) insures a smooth walk as all cleats except 16*a* and 16*b*, and 17*a* and 17*b* are generally in the same horizontal plane.

The preferred embodiment illustrated in FIGS. 1 and 2 is especially suitable for tracking or hunting because this pattern is intended to minimize noise by limiting wearer contact with the ground. That is, the greater the number of cleats, the more noise is likely to be emitted from ground contact. Conversely, larger and fewer cleats with greater depth, width and height, as shown in FIGS. 1 and 2, minimize noise. Additionally, the ovaloid shape of the individual cleats provides for improved traction, as will be better illustrated with reference to other figures.

Figure 3:
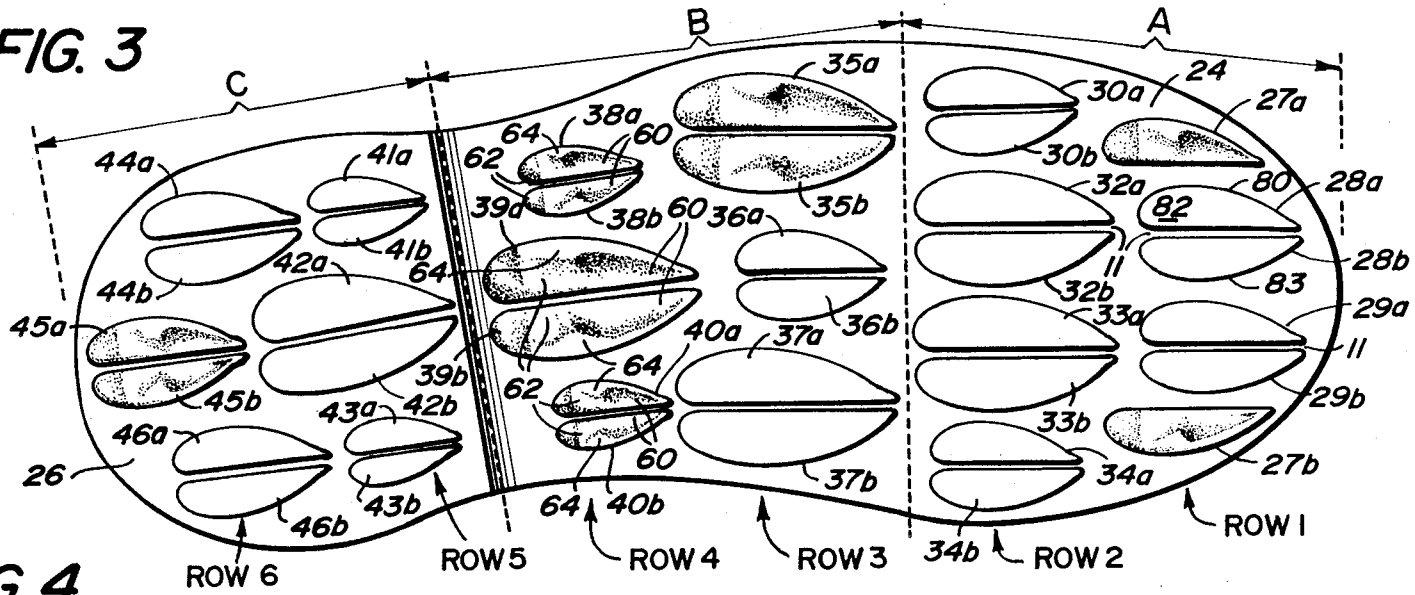
FIG. 3 is a bottom view of another embodiment of a shoe sole including cleats of different sizes and also not shaded for full detail of the cleat pairs.
Figure 4:
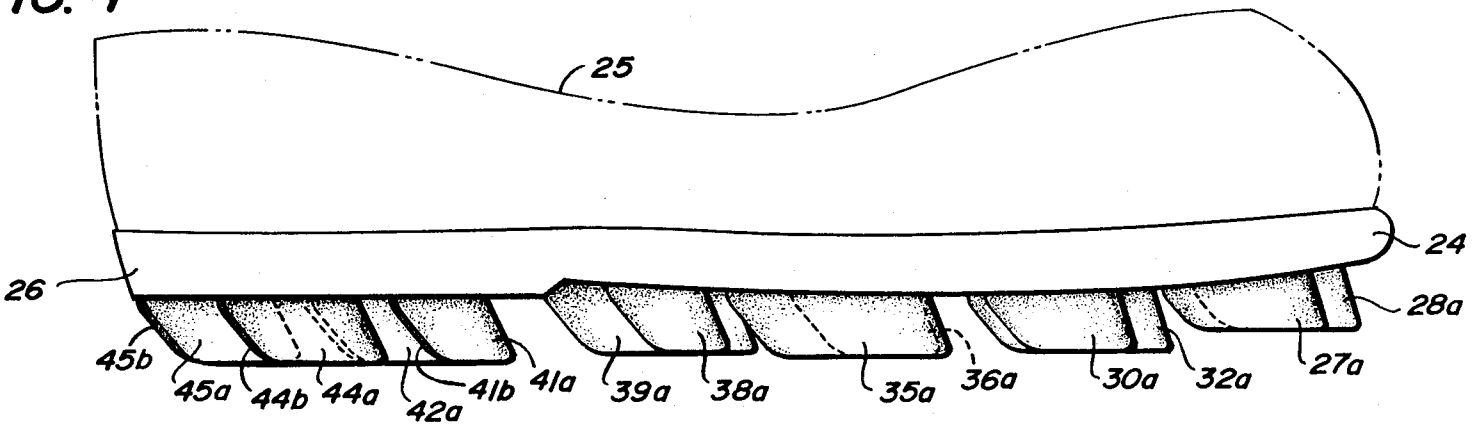
FIG. 4 is a side view of the sole of FIG. 3, a shoe upper shown in phantom.

Now referring to FIGS. 3 and 4, another embodiment of the cleated shoe sole of this invention is illustrated with sole 24, heel 26, and upper 25. In discussion of this embodiment, cleats are referred to by pairs but individually numbered, as for example, cleats 28*a* and 28*b*, or they are discussed in pairs, as for example cleat pair 28. In this embodiment, the cleat pairs are of different sizes and arranged in non-identical rows. In FIG. 3, several cleat pairs (27, 35, 38, 39, 40 and 45) are also shown with some shading detail which will be explained in reference to subsequent figures. FIG. 3 has been sectioned off with dotted lines into toe-off area "A", midstream area "B", and heel area "C", each area having two rows of cleat pairs.

Toe-off area A includes, in row 1 cleat pairs 27, 28 and 29. (For convenience, the rows will begin with row 1 at the sole toe end and progress to row 6 which is the heel end.) Cleat pair 27 is shown separated by more than the narrow valley 11 described in FIG. 1 and is, in fact, separated by cleat pairs 28 and 29. Cleats 28*a* and 28*b* are shown with bases 82 and 83, respectively. This arrangement is illustrated only in FIG. 3's toe-off area A, but could be used in other areas and is intended to lend or provide stability, smoothness and balance to the wearer. Row 2 of area A includes two larger cleat pairs 32 and 33 in the interior metatarsal area with edge (and smaller) pairs 30 and 34 on either side.

Midstream area B in FIG. 3 illustrates smaller cleat pair 36 with larger cleat pairs 35 and 37, while this arrangement is reversed in row 4 with large cleat pair 39 matched with smaller pairs 38 and 40 on either side. This arrangement also is intended to provide stability, smoothness and balance to the wearer. Row 4 cleat shading indicates forward depression 60, rear depression 62, and cusp 64.

Heel area C includes rows 5 and 6. Row 5 is the same arrangement in cleat size as row 4, but row 5 shows a higher (that is, closer to the toe) placement of the cleat pairs 41 and 43. This arrangement allows row 6 small cleat pairs 44, 45 and 46 to be arranged in a semicircle around larger cleat pair 42 to provide balance, smoothness and stability. In general, the larger the cleat size and fewer in number, the less noise and greater traction. Otherwise variation in size and position are not critical. That is, FIG. 3 and FIG. 4 are merely illustrative and it is within the skill of the art to arrange and size the cleats to match individual comfort parameters.

A sole with the cleat arrangement illustrated in FIGS. 3 and 4 is particularly useful for negotiating steep terrains, walking, and climbing because the cleats are deeper; that is, they protrude further from the sole allowing more "bite" into the ground. The largest cleat pairs 42, 39, 35, 37, 32 and 33 are particularly suited to provide maximum grip or traction. It is within the skill of the art to vary the patern to suit individual comfort or balance.

Referring now to FIGS. 5 through 9, and 11 and 12 (which are longitudinal cross sections), details of depressions 60 and 62 and cusp 64 in sole 24 are more clearly seen. FIG. 5 is an enlargement of row 1, cleat pairs 27, 28 and 29 of FIG. 3. FIGS. 6–9 are horizontal cross sections of cleat pairs 28. FIGS. 11 and 12 are cross sections of cleat pair 29 with FIG. 12 a longitudinal view of the cleat inside.

Cleat pair 27 is separated by pairs 28 and 29. Cleat pairs 28 and 29 form mirror images of themselves across valleys 11. Surfaces 82 and 83 are not continuously flat, but include depressions which are illustrated in these figures. Forward depression 60 begins just inside tip 56 (note FIGS. 6, 10 and 11) and gradually widens (note FIGS. 7, 8 and 12) as cleat 28 widens, the outer edge of the depression wall being side 80 (and 85 in mate 28*b*) while base 82 (83 for cleat pair mate 28*b*) widens to form cusp 64 and which becomes the demarcation between depressions 60 and 62. Thus, an "hourglass" is formed by depressions 60 and 62 and their opposing depressions in the cleat mate. Ridge 66 tapers (toward the heel area) as seen in FIG. 9 and forms the end of depression 62. A final rear transverse depression or inward scallop 65 (seen in FIG. 11) forms off the end of ridge 66 to allow a slight rearward rocking toward the heel to stabilize the wearer.

In other words, a cleat is not only generally semi-eliptical in outline, it is also of uneven depth, as measured from sole 20 to the floor or ground. A cleat is deepest along its outer edges, for example walls 86 and 88. A cleat is less deep in forward depression 60, rearward depression 62 and inward scallop 65. Thus, the forward and outer edges of a cleat are deeper than the inward and rearward edges to provide for comfort, traction and quietness.

Referring now to FIG. 10, the overall shape of the cleat, indicated by this front-to-rear view taken on lines 10—10 of FIG. 5, is shown. Tips 56*a* and 56*b* are shown at the lowermost portion of cleats 29*a* and 29*b*. Edges 87 and 89 face each other across valley 11. Cleat 29*b* has outer edge 88 and cleat 29*a* has outer edge 86.

FIG. 12, a longitudinal cross section of cleat pair 29, shows tip 56, depressions 60 and 62, and the side of cusp 64.

There are several variations which can be practiced in the scope of this invention. The size and placement of cleat pairs is optional. The materials of construction may vary, and conventional molding processes can readily be adapted to produce the sole and cleat pairs. The cleats could be manufactured separately, but an integrated molding of sole and cleats is preferred as both practical and economical.

There are many advantages to the cleated footwear of this invention. Chiefly, the size and configuration of the cleats lessen noise and increase traction for hunters, hikers and trackers because of reduced contact of the wearer's foot with the ground surface.

Having now illustrated and described my invention, it is not intended that such description limit this invention, but rather that this invention be limited only be reasonable interpretation of the appended Claims.

What is claimed is:

1. A cleated sole for footwear for the outdoorsman comprising, in combination with a shoe upper:

(a) a footwear sole; and, (b) a plurality of ovaloid pairs of generally identically shaped cleats, each having a flattened cleat base, mounted on said sole's outer face, each said cleat pair together having a generally eliptical flat surface where said cleat pair joins said sole and extending downward and inwardly curved therefrom to the flattened cleat bases, each of said cleat bases including a pair of depressions therein, and wherein each of said cleat pairs is longitudinally bisected so that each pair member is spaced apart from, and a mirror of, its mate, the depressions in the cleats of each pair together forming an hourglass hollow in said cleat pair.

2. The cleated sole for footwear according to claim 1 wherein said longitudinal bisection defines facing longitudinal walls and said depressions are on each cleat along said cleat's longitudinal wall, one behind the other and separated by a cusp.

3. The cleated sole for footwear according to claim 1 wherein said ovaloid is tear drop in configuration and said cleats are aligned with the teardrop tip pointing towards said sole front.

4. The cleated sole for footwear according to claim 4 wherein said shoe sole is from about one-quarter to an inch to about one inch deep.

5. The cleated sole for footwear according to claim 4 wherein said cleat is from about one quarter of an inch to about one and a quarter inches deep.

6. The cleated sole for footwear according to claim 1 wherein said sole and cleats are provided as a unitary molded unit.

7. The cleated sole for footwear according to claim 1 wherein said cleat pairs are positioned on said sole side by side in rows.

8. The cleated sole for footwear according to claim 1 wherein said cleat pairs are positioned on said sole in random order.

9. The cleated sole for footwear according to claim 1 wherein said cleat pairs are the same size.

10. The cleated sole for footwear according to claim 1 wherein said cleat pairs are two different sizes.

* * * * *

UNITED STATES PATENT AND TRADEMARK OFFICE

CERTIFICATE OF CORRECTION

PATENT NO. : 4,769,931

DATED : September 13, 1988

INVENTOR(S) : Donald W. Morrow and Richard C. Cotton

It is certified that error appears in the above-identified patent and that said Letters Patent are hereby corrected as shown below:

In Column 1, line 43, following the word "randomly" delete "placed the" and insert therfor -- placed. the --.

In Column 4, line 23, following the second occurrence of the word "the", delete the word "patern" and insert therefor -- pattern --.

Column 6, Claim 4, following the word "claim", delete "4" and insert therefor -- 3 --.

Column 6, Claim 5, following the word "claim", delete "4" and insert therefor -- 3 --.

Signed and Sealed this

Eighteenth Day of April, 1989

*Attest:*

DONALD J. QUIGG

*Attesting Officer*

*Commissioner of Patents and Trademarks*